US011381022B2

(12) United States Patent
Hsu

(10) Patent No.: US 11,381,022 B2
(45) Date of Patent: Jul. 5, 2022

(54) ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Shuo-Hsiu Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/134,545

(22) Filed: Dec. 28, 2020

(65) Prior Publication Data

US 2021/0203097 A1 Jul. 1, 2021

(30) Foreign Application Priority Data

Dec. 27, 2019 (CN) ..... 201911380056.3

(51) Int. Cl.
*H01R 13/24* (2006.01)
*H01R 12/71* (2011.01)
*H01R 12/70* (2011.01)

(52) U.S. Cl.
CPC ..... *H01R 13/24* (2013.01); *H01R 12/714* (2013.01); *H01R 12/7076* (2013.01); *H01R 12/7082* (2013.01)

(58) Field of Classification Search
CPC ..... H01R 23/722; H01R 9/096; H01R 13/24; H01R 12/714; H01R 12/7076; H01R 12/7082
(Continued)

(56) References Cited

U.S. PATENT DOCUMENTS 4,362,353 A * 12/1982 Cobaugh ..... H05K 7/10 29/882
4,655,519 A * 4/1987 Evans ..... H05K 7/1069 439/514
(Continued)

FOREIGN PATENT DOCUMENTS

CN 107968272 B 8/2019
CN 107093827 B 9/2019
CN 108847539 B 11/2019

*Primary Examiner* — Gary F Paumen
(74) *Attorney, Agent, or Firm* — Ming Chieh Chang; Wei Te Chung

(57) ABSTRACT

A contact unit for use within a connector includes a primary piece essentially composed of an upper part and a lower part coupled with each other. The upper part includes an upper retaining section and a resilient upper contacting arm with an upper contacting section and an upper abutment section at a free end thereof. The lower part includes a lower retaining section and a resilient lower contacting arm extending downwardly with a lower contacting section and a lower abutment section at a free end thereof. A secondary piece is spaced from and opposite to the primary piece in a horizontal direction of the contacting arm, and includes an upper abutment region adapted to be abutted against by the upper abutment section of the upper contacting arm, and a lower abutment region adapted to be abutted against by the lower abutment section of the lower contacting arm.

20 Claims, 8 Drawing Sheets

(58) Field of Classification Search
USPC ..... 439/66, 515
See application file for complete search history.

(56) References Cited

U.S. PATENT DOCUMENTS

| | | | | |
|---|---|---|---|---|
| 7,134,878 | B2 * | 11/2006 | Zheng | H01R 13/2421 439/65 |
| 7,160,115 | B2 | 1/2007 | Hai | |
| 7,819,669 | B2 | 10/2010 | Hai | |
| 8,353,730 | B1 * | 1/2013 | Wang | H01R 13/2421 439/700 |
| 9,088,083 | B2 * | 7/2015 | Mason | H05K 7/1069 |
| 9,425,525 | B2 | 8/2016 | Amphenol | |
| 9,882,296 | B1 | 1/2018 | Lotes | |
| 9,954,312 | B1 | 4/2018 | Lotes | |
| 10,230,177 | B2 | 3/2019 | Lotes | |
| 10,483,666 | B2 | 11/2019 | Tyco | |
| 10,535,946 | B2 | 1/2020 | Lotes | |
| 10,707,606 | B2 * | 7/2020 | Ho | H01R 12/57 |
| 2020/0313321 | A1 | 10/2020 | Lotes | |
| 2020/0328550 | A1 | 10/2020 | Lotes | |

* cited by examiner

ELECTRICAL CONNECTOR

BACKGROUND OF THE INVENTION

Field of the Invention

The present invention relates to an electrical connector for use with a CPU (Central Processing Unit), and particularly to the contact of the connector being made of multiple pieces.

Description of Related Arts

U.S. Patent Application Publication No. 2020/0328550 discloses an electrical connector having a plurality of contact units each including a primary piece providing a pair of opposite deflectable contacting arms for respectively contacting the CPU (Central Processing Unit) and the PCB (Printed Circuit Board), and a secondary piece providing a side upstanding bar for respectively linking the two contacting arms to create a secondary transmission path other than the primary transmission path performed by the primary piece so as to enhance the high frequency signal transmission. Anyhow, such a side upstanding bar may take additional space in the passageway in the sideward direction, thus being unwelcome the miniaturization trend.

Therefore, it is desired to provide an electrical connector with a plurality of contact units each including a primary piece with a pair of opposite deflectable contacting arms, and a secondary piece opposite to the primary piece in the deflection direction of the contacting arms to contact the contacting arms in the deflection direction wherein the secondary piece is essentially encircled by the primary piece for saving space.

SUMMARY OF THE INVENTION

To achieve the above object, an electrical connector for mating with the CPU unit, includes an insulative housing with a plurality of passageways extending therethrough in the vertical direction. A plurality of contact units are disposed within the corresponding passageways, respectively. Each contact unit includes a primary piece essentially composed of an upper part and a lower part coupled with each other. The upper part includes an upper retaining section and a resilient upper contacting arm extending upwardly above the upper surface of the housing with an upper contacting section and an upper abutment section at a free end thereof. The lower part includes a lower retaining section and a resilient lower contacting arm extending downwardly below the lower surface of the housing with a lower contacting section and a lower abutment section at a free end thereof. A secondary piece is spaced from and opposite to the primary piece in a horizontal direction, and includes an upper abutment region adapted to be abutted against by the upper abutment section of the upper contacting arm, and a lower abutment region adapted to be abutted against by the lower abutment section of the lower contacting arm. The upper abutment section is essentially located on an outer side of the upper abutment region, and the passageway includes additional space to allow outward deflection of the upper abutment section in the deflection direction. The relation among the lower abutment section, the lower abutment region and the passageway is similar to that of the upper abutment section, the upper abutment region and the passageway. Therefore, the second piece is deemed encircled by the primary piece in a side view along another horizontal direction perpendicular to the deflection horizontal direction. To achieve the foregoing structures, the upper part is downwardly assembled into the passageway while the lower part is upwardly assembled into the passageway.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
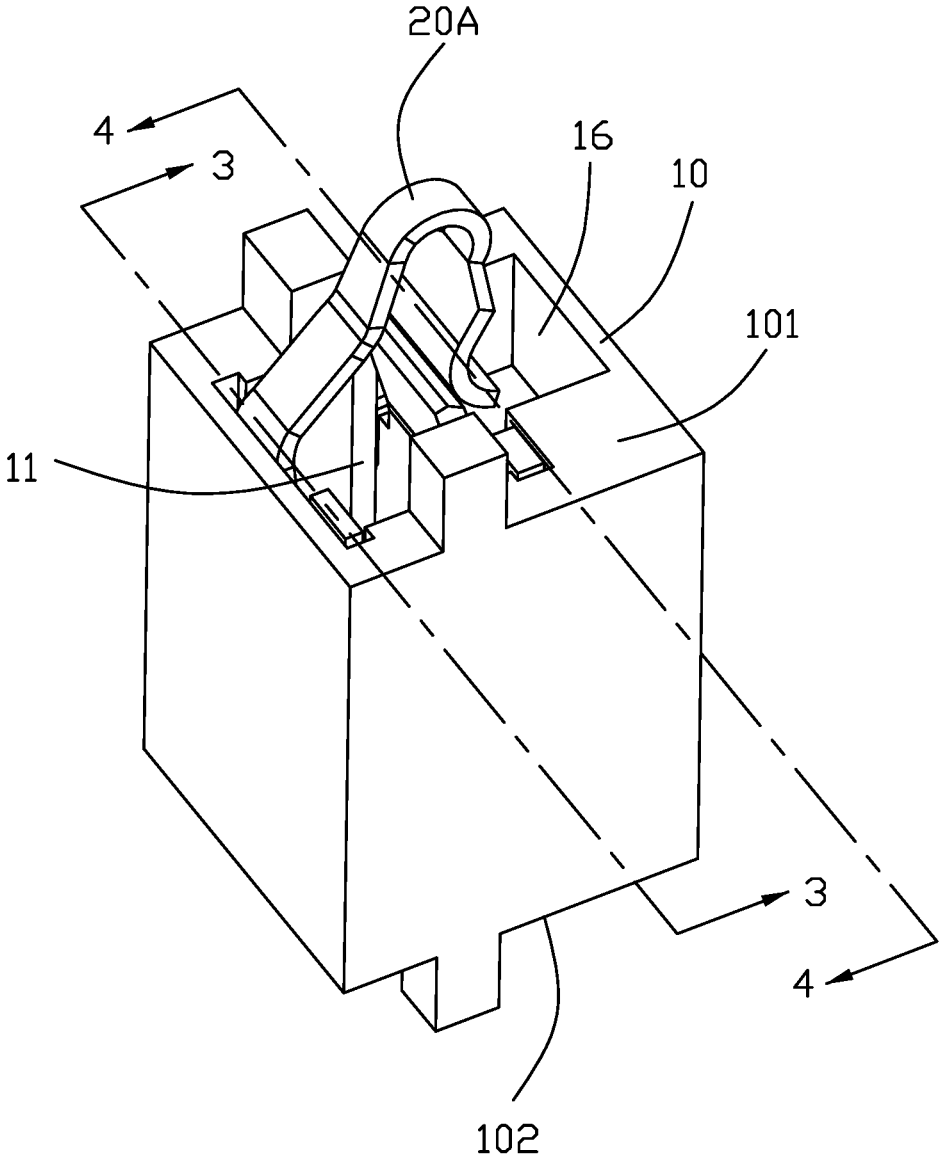
FIG. 1 is a perspective view of an electrical connector of the invention.
Figure 2:
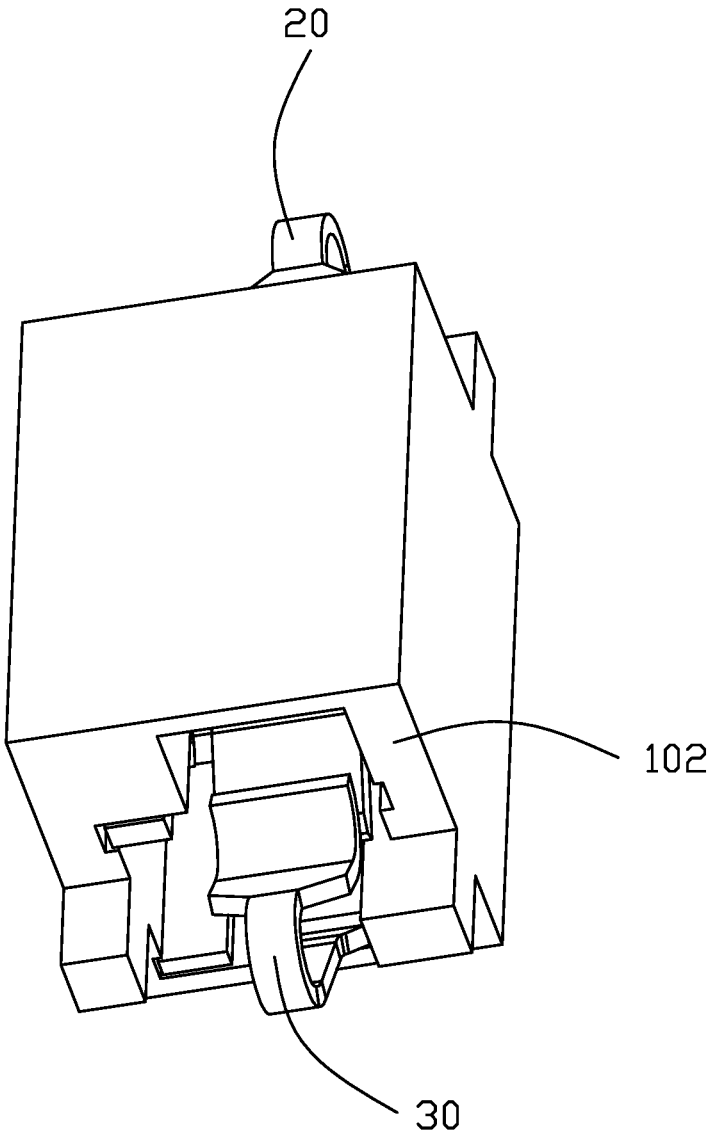
FIG. 2 is another perspective is another perspective view of the electrical connector of FIG. 1.

Referring to FIGS. 1-8, an electrical connector 100 for connecting a PCU to a PCB, includes an insulative housing 10 with opposite upper surface 101 and lower surface 102, and a plurality of passageways 11 (only one shown exemplarily) extending through both the upper surface 101 and the lower surface 102. A plurality of contact units 20A (only one shown exemplarily) are disposed in the corresponding passageways 11, respectively.

Each contact unit 20A includes a primary piece composed of the upper part, i.e., the first part 20, and a lower part, i.e., the second part 30, and a secondary piece composed of the middle part 40, i.e., the third part. The upper part 20 includes an upper/first retaining section 21 retained in the housing 10, and an upper/first contacting arm 22 upwardly extending from an upper end of the upper retaining section 21 with an upper/first contacting section 23 exposed above the upper surface 101 and an upper/first abutment section 24 at a free end. Similarly, and symmetrically, the lower part 30 includes a lower/second retaining section 31 retained in the housing 10, and a lower/second contacting arm 32 downwardly extending from a lower end of the lower retaining section 31 with a lower/second contacting section 33 exposed below the lower surface 102 and a lower/second abutment section 34 at a free end thereof. The middle part 40 includes a middle/third retaining section 41, an upper/first abutment region 42 at the upper end thereof for abutment with the upper abutment section 24, and a lower/second abutment region 43 at a lower end thereof for abutment with the lower abutment section 34.

Figure 7:
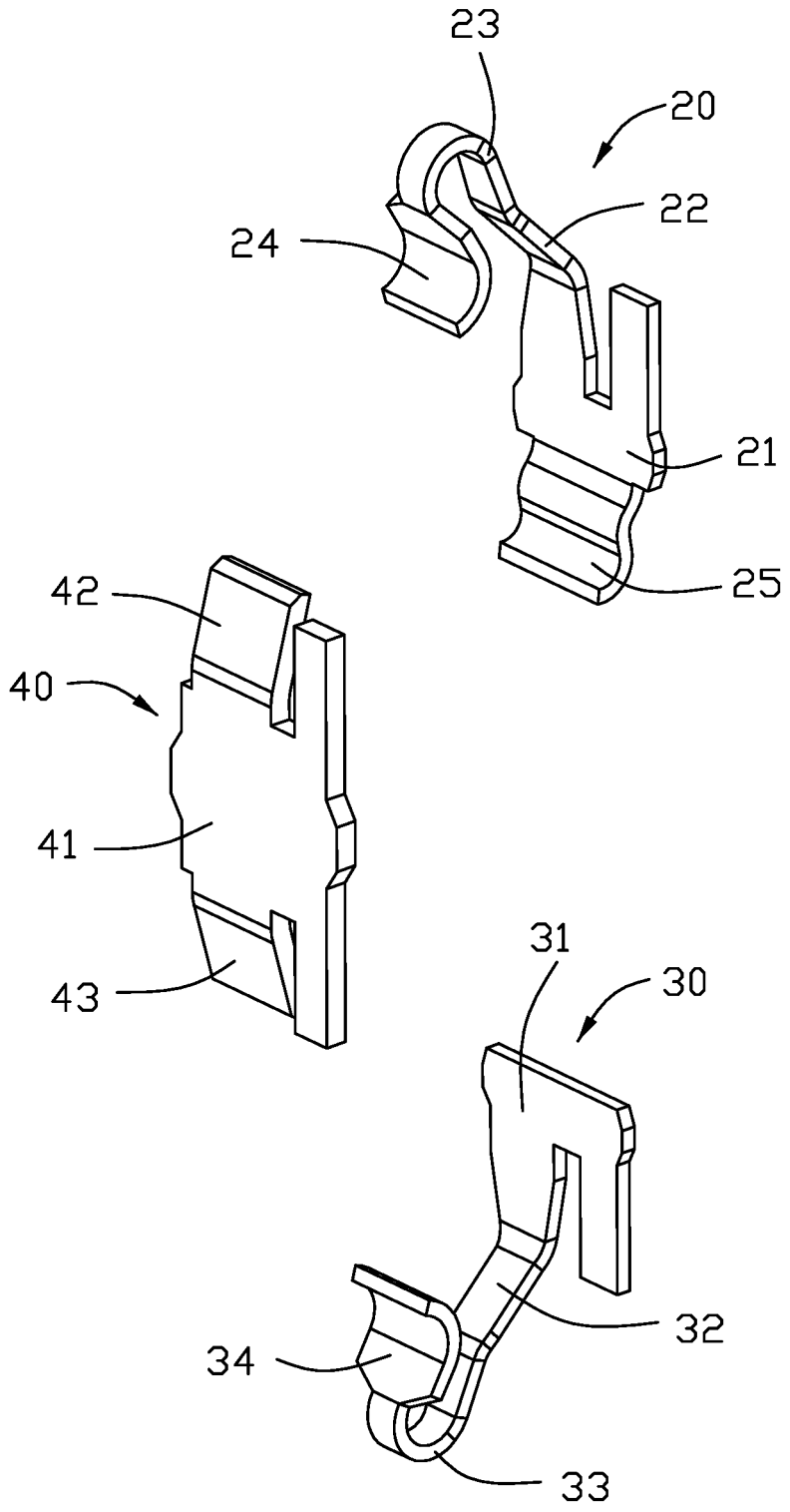
FIG. 7 is an exploded perspective view of the contact of the electrical connector of FIG. 5.
Figure 8:
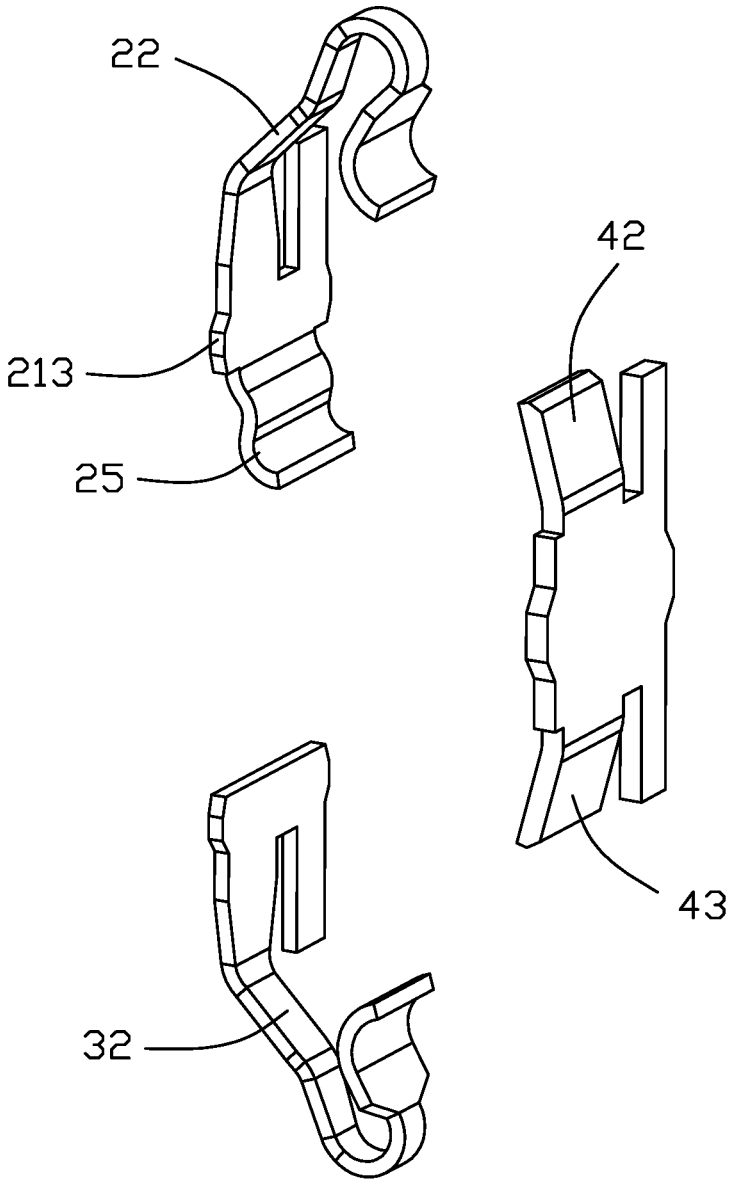
FIG. 8 is another exploded perspective view of the contact of the electrical connector of FIG. 7.

Understandably, the upper abutment section 24 may downwardly move along the upper abutment region 42 when the upper contacting arm 22 is downwardly pressed by the CPU, and the lower abutment section 34 is upwardly moved along the lower abutment region 43 when the lower contacting arm 32 is upwardly pressed by the PCB. Notably, the upper part 20, the lower part 30 and the middle part 40 are discrete from one another so that the material of the middle part 40 can be different from those of the upper art 20 and the lower part 30. In this embodiment, as shown in FIGS. 7 and 8, on one hand the middle part is thicker than the upper part 20 and the lower part 30 for enhancing electrical transmission. On the other hand, because the middle part 40 is not required to form the spring arm which requires the superior mechanical characteristic so that the material of the middle part 40 can be of a relatively inexpensive material compared with the upper part 20 and the lower part 30 which require the superior material for performing the required mechanical and electrical function. This allows flexible manufacturability thereof advantageously.

The upper abutment region 42 extends toward the upper contacting arm 22, and the lower abutment region 43 extends toward the lower contacting arm 32 as well. Therefore, the upper abutment section 24 can slide upon the outer side of the upper abutment region 42, and the lower abutment section 34 can slide upon the outer side of the lower abutment region 43. Because of the structural relation among the upper part 20, the lower part 30 and the middle part 40, the middle part 40 is required to be firstly assembled into one side of the passageway 11, and successively the upper part 20 is required to be downwardly assembled into the other side of the passageway 11, and the lower part 30 is required to be upwardly assembled into the other side of the passageway 11 without hindrance. With this structure arrangement, the second piece may be deemed encircled within primary piece.

In this embodiment, the upper part 20 and the lower part 30 are mechanically and electrically connected with each other wherein the upper part 20 includes a middle abutment section 25 downwardly extending from a lower end of the upper retaining section 21 to abut against a middle abutment region (not labeled located on an upper end of the lower retaining section 31. Based upon this structural arrangement, there are two parallel transmission paths between the upper contacting section 23 and the lower contacting section 33, of which one is from the upper abutment section 24, the upper abutment region 42, the middle part 40, the lower abutment region 43, to the lower abutment section 34, and the other is from the upper contacting arm 22, the upper retaining section 21, the middle abutment section 25, the lower retaining section 31 to the lower contacting arm 32. Therefore, the superior impedance match and the lower loss can be achieved for perfecting the high frequency transmission.

Figure 3:
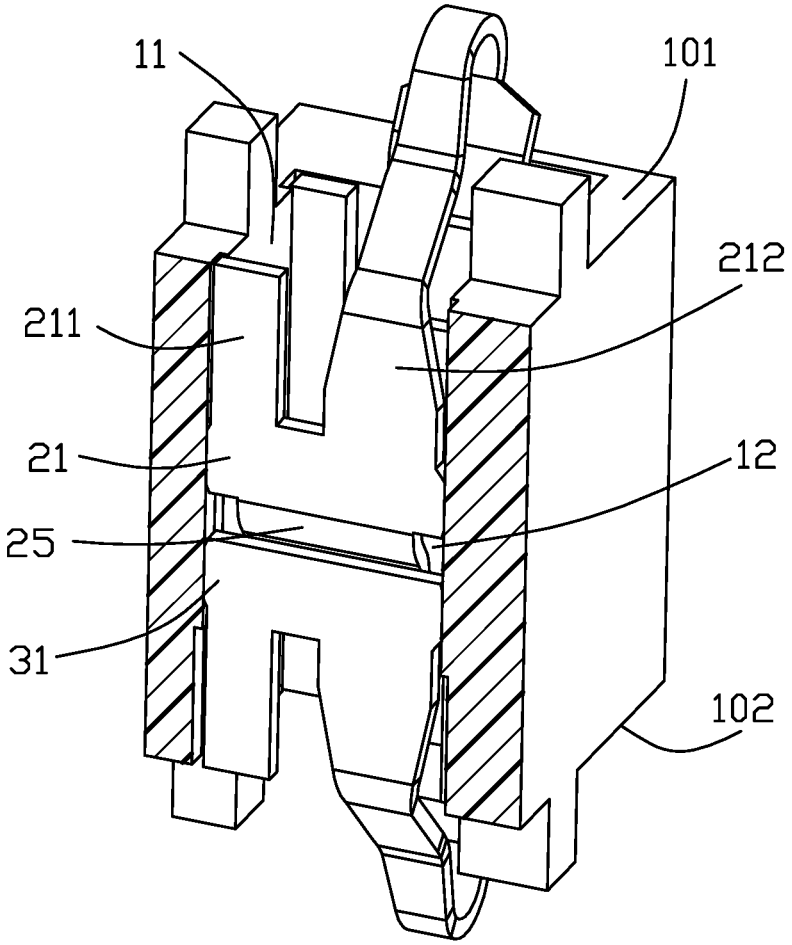
FIG. 3 is a cross-sectional view of the electrical connector of FIG. 1 along line 3-3.
Figure 4:
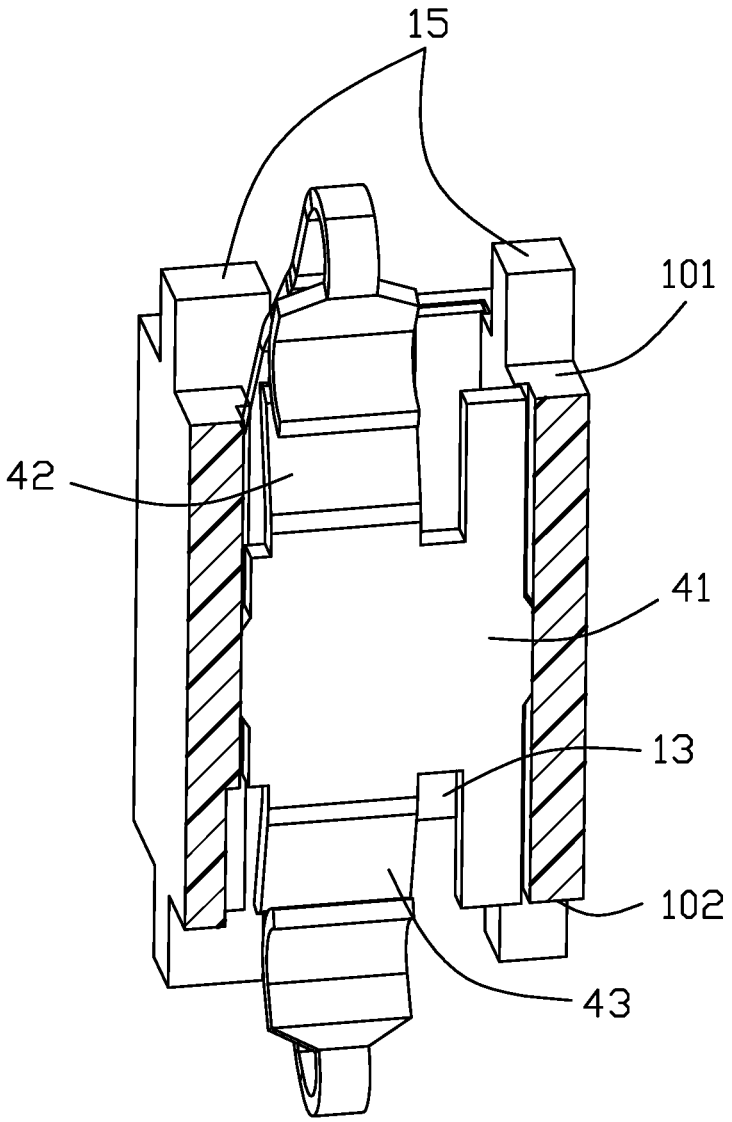
FIG. 4 is a cross-sectional view of the electrical connector assembly of FIG. 1 along line 4-4.
Figure 5:
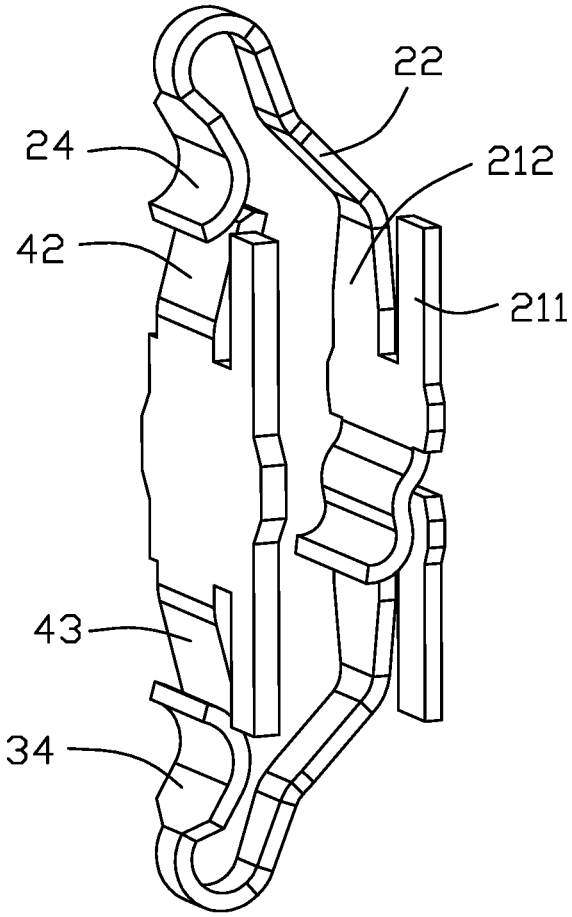
FIG. 5 is a perspective view of the contact of the electrical connector of FIG. 1.
Figure 6:
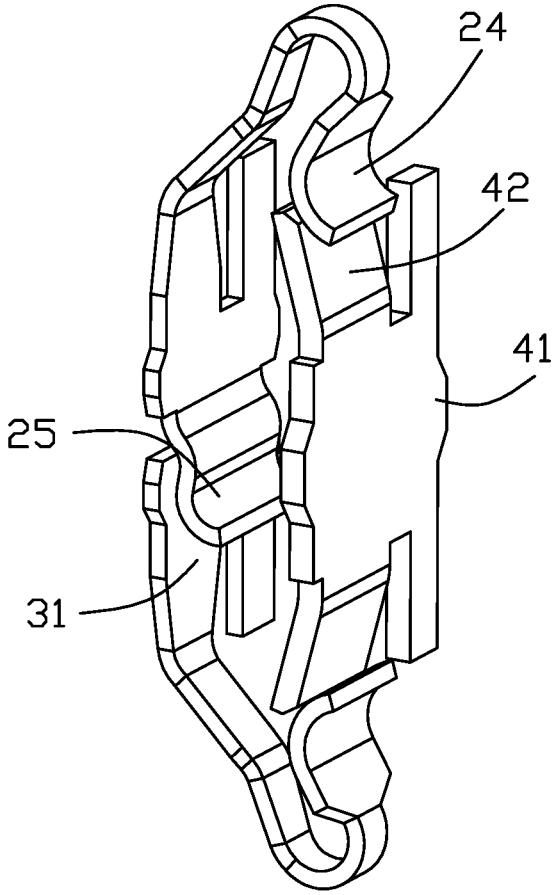
FIG. 6 is another perspective view of the contact of the electrical connector of FIG. 5.

As shown in FIGS. 3 and 4, the passageway 11 includes a first groove 12 and a second groove 13 opposite to each other along an extending direction of the contacting arm. The upper retaining section 21 is received in an upper portion of the first groove 12, and the lower retaining section 31 is received within a lower portion of the first groove 12. The middle retaining section 41 is received within the second groove 13. Notably, all the upper retaining section 21, the lower retaining section 31 and the middle retaining section 41 are equipped with barbs on two sides for interference.

The upper retaining section 21 forms a slot so as to form an upward extension 211 for linking to a contact carrier (not shown) for downwardly assembling the upper part 20 into the passageway 11, and an upper connecting section 212 spaced from the upward extension 211 for connecting the upper contacting arm 22. Similarly, the lower retaining part 31 forms a slot to form the downward extension (not labeled) for linking to another contact carrier (not shown) for upwardly assembling the lower part 30 into the passageway 11, and a lower connecting section (not labeled) spaced from the downward extension (not labeled) for connecting the lower contacting arm 32. In addition, as shown in FIG. 4, the upper surface 101 and the lower surface 102 form standoffs 15 for supporting the CPU and the PCB. As shown in FIG. 1, the passageway 11 further includes an additional space 16 on an outer side of the first groove 12 for accommodating outward deflection of the abutment sections when the abutment section abuts against the abutment region.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including a plurality of passageways extending through opposite upper and lower surfaces in a vertical direction;

a plurality of contact units disposed within the corresponding passageways, respectively, each of the contact units including:

a primary piece essentially composed of an upper part and a lower part discrete from each other in the vertical direction, the upper part including a resilient upper contacting arm with an upper contacting section exposed above the upper surface and an upper abutment section at a free end thereof, the lower part including a resilient lower contacting arm with a lower contacting section exposed below the lower surface and a lower abutment section at a free end thereof, and a secondary piece spaced from and opposite to the primary piece in a first horizontal direction perpendicular to the vertical direction, the secondary piece being essentially composed of a middle part with an upper abutment region adapted to be abutted against by the upper abutment section and a lower abutment region adapted to be abutted against by the lower abutment section.

2. The electrical connector as claimed in claim 1, wherein the upper part includes an upper retaining section secured to the housing, and the upper contacting arm extends from an upper end of the upper retaining section.

3. The electrical connector as claimed in claim 2, wherein the lower part includes a lower retaining section secured to the housing, and the lower contacting arm extends from a lower end of the lower retaining section.

4. The electrical connector as claimed in claim 3, wherein both the upper retaining section and the lower retaining section are aligned in a same vertical plane.

5. The electrical connector as claimed in claim 3, wherein one of the upper retaining section and the lower retaining section forms an abutment section to contact the other for electrical connection therebetween.

6. The electrical connector as claimed in claim 2, wherein the upper abutment section is located on an outer side of the upper abutment region opposite to the upper retaining section which is located at an inner side of the upper abutment section.

7. The electrical connector as claimed in claim 6, wherein the passageway further includes additional space to accommodate outward deflection of the upper abutment section.

8. The electrical connector as claimed in claim 6, wherein the upper abutment region extends obliquely toward the upper retaining section.

9. The electrical connector as claimed in claim 8, wherein the upper abutment section is curved.

10. The electrical connector as claimed in claim 6, wherein the lower abutment section is located on an outer side of the lower abutment region and symmetrically arranged with the upper abutment section in the vertical direction.

11. The electrical connector as claimed in claim 2, wherein the upper retaining section forms a slot to have an upward extension for linking a contact carrier, and an upper connection section spaced from the upward extension by said slot in a second horizontal direction perpendicular to both the vertical direction and the first horizontal direction for connecting the upper contacting arm.

12. The electrical connector as claimed in claim 1, wherein both the primary piece and the secondary piece are stamped from sheet metal while the secondary piece is thicker than the primary piece.

13. An electrical connector comprising:

an insulative housing including a plurality of passageways extending through opposite upper and lower surfaces in a vertical direction;

a plurality of contact units disposed within the corresponding passageways, respectively, each of the contact units including:

a primary piece essentially composed of an upper part and a lower part discrete from each other in the vertical direction, the upper part including a resilient upper contacting arm with an upper contacting section exposed above the upper surface and an upper abutment section at a free end thereof, the lower part including a resilient lower contacting arm with a lower contacting section exposed below the lower surface and a lower abutment section at a free end thereof, and a secondary piece discrete from the primary piece and being essentially composed of a middle part with an upper abutment region adapted to be abutted against by the upper abutment section and a lower abutment region adapted to be abutted against by the lower abutment section; wherein the upper part includes an upper retaining section secured to the housing, and the upper contacting arm extends from an upper end of the upper retaining section, and the lower part includes a lower retaining section secured to the housing, and the lower contacting arm extends from a lower end of the lower retaining section.

14. The electrical connector as claimed in claim 13, wherein both the upper retaining section and the lower retaining section are aligned in a same vertical plane.

15. The electrical connector as claimed in claim 13, wherein one of the upper retaining section and the lower retaining section forms an abutment section to contact the other for electrical connection therebetween.

16. The electrical connector as claimed in claim 13, wherein the upper abutment section is located on an outer side of the upper abutment region opposite to the upper retaining section which is located at an inner side of the upper abutment section.

17. The electrical connector as claimed in claim 16, wherein the passageway further includes additional space to accommodate outward deflection of the upper abutment section.

18. The electrical connector as claimed in claim 16, wherein the upper abutment region extends obliquely toward the upper retaining section.

19. A method of making an electrical connector, comprising steps of:

providing an insulative housing with a plurality of passageways extending therethrough in a vertical direction;

inserting a middle part into a first groove in the passageway wherein the middle part forms an upper abutment region and a lower abutment region in the vertical direction;

downwardly inserting an upper part into a second groove spaced from the first groove in a horizontal direction, which is perpendicular to the vertical direction, in the passageway wherein the upper part forms a resilient upper contacting arm with an upper contacting section exposed above the housing and an upper abutment section adapted to abut against the upper abutment region; and upwardly inserting a lower part into a third groove in the passageway wherein the lower part forms a resilient lower contacting arm with a lower contacting section exposed below the housing and a lower abutment section adapted to abut against the lower abutment region; wherein the upper abutment section is aligned with the lower abutment section in the vertical direction and both are located on an outer side of the middle part.

20. The method as claimed in claim 19, wherein both the upper abutment region and the lower abutment region extend obliquely toward the upper part and the lower part in the horizontal direction.

* * * * *